US005526612A

United States Patent [19]

Wade

[11] Patent Number: 5,526,612

[45] Date of Patent: Jun. 18, 1996

[54] LEAF FREE GUTTER AND DOWNPIPE RAIN HEAD

[76] Inventor: Rodney G. Wade, P.O. Box 270, Oxenford, Queensland, Australia, 4210

[21] Appl. No.: 318,808

[22] PCT Filed: Apr. 7, 1993

[86] PCT No.: PCT/AU93/00154

§ 371 Date: Oct. 17, 1994

§ 102(e) Date: Oct. 17, 1994

[87] PCT Pub. No.: WO93/22525

PCT Pub. Date: Nov. 11, 1993

[30] Foreign Application Priority Data

May 1, 1992 [AU] Australia ..... PL2207
May 14, 1992 [AU] Australia ..... 16239/92

[51] Int. Cl.[6] ..... E04D 13/08

[52] U.S. Cl. ..... 52/12; 52/11; 52/13; 52/16; 210/474; 210/482

[58] Field of Search ..... 52/12 OR, 11, 52/13, 16; 210/463, 474, 477, 482

[56] References Cited

U.S. PATENT DOCUMENTS

| | | | |
|---|---|---|---|
| 3,053,393 | 9/1962 | McLean | 52/12 X |
| 4,253,281 | 3/1981 | Ruttenberg | 52/12 |
| 4,472,274 | 9/1984 | Williams . | |
| 4,608,786 | 9/1986 | Beam | 52/16 |
| 4,615,153 | 10/1986 | Carey | 52/16 X |
| 4,798,028 | 1/1989 | Pinion . | |
| 4,801,377 | 1/1989 | Bolt | 52/16 X |
| 4,927,604 | 5/1990 | Mathus et al. | 210/474 X |
| 5,107,635 | 4/1992 | Carpenter | 210/474 X |
| 5,109,640 | 5/1992 | Creson | 210/474 |
| 5,114,594 | 5/1992 | Rosebrock et al. | 52/16 X |
| 5,308,483 | 5/1994 | Sklar et al. | 210/474 X |
| 5,388,377 | 2/1995 | Faulkner | 52/12 X |

FOREIGN PATENT DOCUMENTS

| | | |
|---|---|---|
| 58434/86 | 12/1986 | Australia . |
| 2132657 | 7/1984 | United Kingdom . |

*Primary Examiner*—Wynn E. Wood
*Attorney, Agent, or Firm*—Robbins, Berliner & Carson

[57] ABSTRACT

A device for use in association with roof gutters and downpipes for the purpose of removing debris and like items from rainwater as it flows into the downpipe. The device comprises a box compartment having an upwardly facing inclined inlet over which a primary screen is located, and a lower outlet connected to a downpipe through which the filtered water passes. Debris is washed over the inclined screen to the exterior of the device. More than one screen of varying mesh size may be provided.

6 Claims, 1 Drawing Sheet

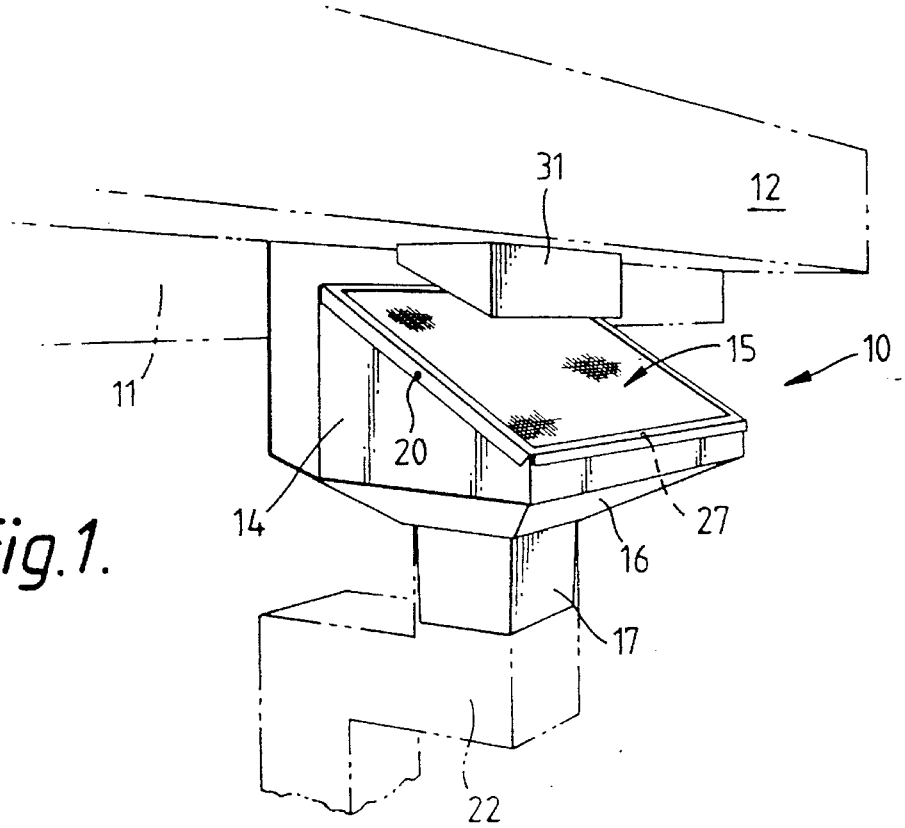
Fig.1.
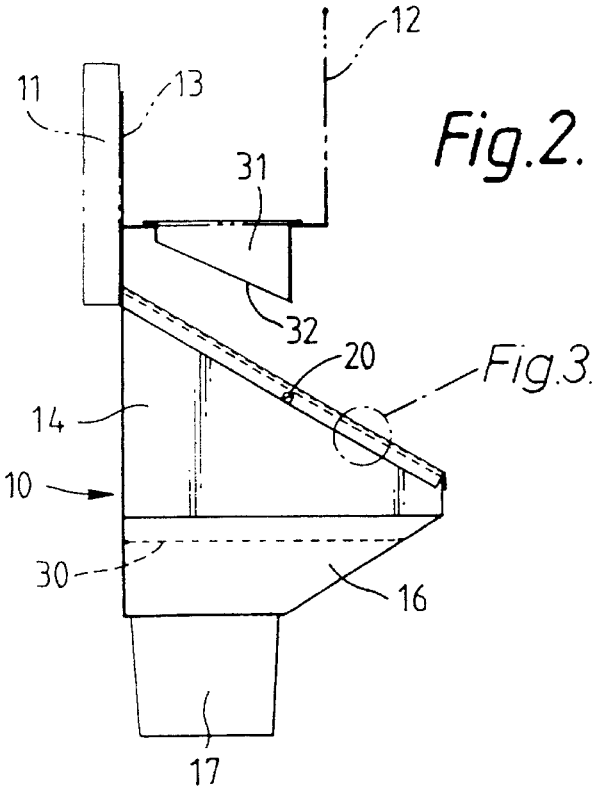
Fig.2.
Fig.3.
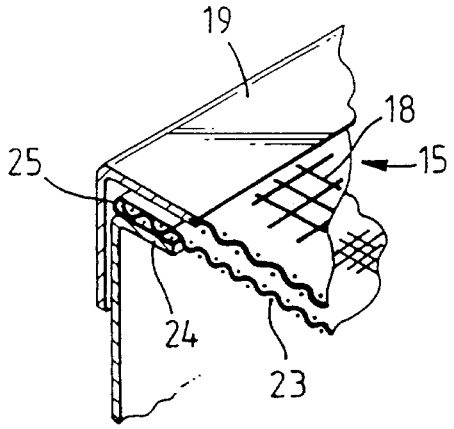
Fig.3.

LEAF FREE GUTTER AND DOWNPIPE RAIN HEAD

This invention relates to a device for use in association with roof gutters and downpipes for the purpose of removing leaves, vermin, debris and other material from rainwater as it flows into the downpipe.

There is currently no effective means for disposing of leaves and other matter which accumulates in roof gutters. Most attempts to solve the problem of blocked gutters and downpipes have been directed to the provision of some form of mesh or like barrier which fits into, or is integral with the gutter, and permits the water to flow through it into the gutter while the debris is blocked from doing so on the top, from where it can be removed by hand. The main problem with these types of barriers is that they tend to clog up quickly and therefore impede the flow of water through them, with the result that the water flows over the edge of the gutter. Another problem is that such systems require the entire length of the gutter to be covered, which in some buildings can be difficult to achieve and, moreover, is relatively expensive.

With such problems in mind, various recent attempts have been made to produce devices which enable the leaves and debris to be removed directly from either the gutter or the downpipe. One such device comprises a funnel arrangement which is inserted in an intermediate cut-off section of the downpipe. Water flows from the upper section of the existing downpipe into the funnel opening and large objects are retained in the conical section of the funnel while the water passes on through. The main disadvantage of such a device, however, is that it must be constantly cleaned out to prevent blockage.

It is therefore an object of the present invention to provide a device which effectively removes the debris, leaves and other large obstructions from gutters and downpipes and which does not require continual maintenance to be effective.

According to the present invention, there is provided a device for separating debris and other such material from rainwater as it flows into a downpipe from a roof gutter and for simultaneously preventing the ingress of mosquitos into the downpipe, said device comprising a compartment adapted for fitting to the upper end of the downpipe, which compartment includes an upwardly facing inlet having a main screen with a mesh size of between 5 mm×5 mm and 12.5 mm×12.5 mm arranged at an angle of between 20° and 45° with respect to the horizontal so that the debris washes over it for discharge outside the device while the rainwater passes on through a secondary screen of smaller mesh opening than the main screen which is closely spaced from the main screen and which acts as a secondary filter below the main screen, said device including a horizontally arranged tertiary screen having a mesh opening of approximately 0.9 mm×0.9 mm located below said secondary screen in such a manner that a head of water forms over said tertiary screen and which acts as a tertiary filter for excluding the ingress of mosquitos.

By the term "upper end of the downpipe" is meant an upwardly opening end which may be at the top of the downpipe or at any location between the top and bottom, which has been formed by removing an intermediate section to leave one part with an upwardly opening end and another with a downwardly opening end. That is, the device may be located in any region of the downpipe but for maximum effectiveness it should be located adjacent to the gutter at the top end. The reason for this is that a large size outlet can be made in the gutter, which can be bigger than the diameter of the downpipe, to enable extra large objects such as twigs, dead birds and other such large items to pass out of the gutter, which would not fit into a conventionally sized downpipe. The large size outlet in the gutter will suitably include a pop, or downwardly depending walled insert, which directs the water and debris into the separating device. The pop has the dual function of also ensuring that the water and debris passing between the gutter and separating device is not blown away from the separating device in windy locations. This device directs the flow of the water and debris on to the screen in a specific location so as to maximise the screening process. In other words, it directs the water and debris to the top of the screen.

The pop will suitably depend downwardly from the gutter by a maximum amount between about 20 and 70 mm, preferably about 50 mm and will have an outlet which is inclined at a similar angle to the screen in the separator. In order to permit the passage of large items through it, the pop has a relatively long length as compared with its width, which is restricted to be compatible with the width of the gutter and the fact that it is most conveniently fixed thereto by a lip around its upper edge which is pop-riveted or otherwise affixed to the gutter. Suitable dimensions will generally be between 75 mm and 100 mm in width, depending upon the width of the gutter, and 150 mm to 300 mm in length. A most preferred size is 200 mm×75 mm.

The outlet from the pop will be located in close proximity to the inlet of the compartment; the exact distance of separation being dependant upon the particular application. Thus, for locations which are subject to small sized debris, the distance of separation between the two can be virtually zero but for locations where vermin, twigs, tennis balls or other large items collect in the gutter, the separation can be up to 100 mm. Generally however, in the majority of situations, a separation of about 50 mm is found to be most suitable.

As an alternative to the pop, a section of the gutter could be cut and folded to produce a downwardly depending flap which functions similarly to the pop.

As mentioned, the inclination of the pop outlet is suitably the same as that of the screen in the separator. The preferred degree of inclination is about 30°. The screen is preferably arranged in, or constitutes, the upper wall of the separator. Such a screen can be removed from the compartment by removing retaining screws or like fixing means, for the purpose of replacement or cleaning, or for accessing the interior of the compartment.

The screen will suitably be fabricated from a non-corrosive material such as a plastics material or metal. Metal screens are preferred as they are less prone to damage and are longer wearing. Preferred metal screens are welded or wire woven stainless steel, zincalum, galvanized steel, brass, copper and fibreglass mesh. The mesh type and size will depend on the application. For large size items welded galvanized steel mesh may be adequate whereas woven stainless steel may be most appropriate for small items. Generally, however, for the majority of general purpose locations, the mesh size will be one of the standard sizes of 5 mm, 7 mm, 9 mm or 12.5 min.

A discharge shute is suitably included in the lower portion of the compartment to direct the screened water into the upper end of the downpipe. The discharge shute is preferably shaped and tapered so as to wedge into the downpipe to facilitate placement. To this end, it will have a conical or pyramidal shape depending on whether the downpipe is circular or rectangular in cross-section.

The compartment preferably has a rectangular outer dimension with an inclined lower wall which opens into the discharge shute. It can be fixed in position to the fascia which supports the gutter, or to the wall of the building, by screws or the like which pass through a backing panel formed integrally with, or joined to, the rear wall of the separated compartment.

In use, because water and debris has unimpeded exit from the gutter, all debris flows onto the main separator screen and the large components wash out onto the ground. Smaller particles are trapped in the secondary and, optionally tertiary, screen where drinking water is required. The device thus permits all water and small and large debris including vermin to exit the roof gutter, thus reducing flooding due to overflowing blocked gutters, fire due to dried leaves, and health hazards due to dead vermin such as birds. The device is, moreover, substantially self cleaning with very little maintenance ever being required.

A preferred embodiment of the invention will now be described with reference to the accompanying drawings, in which:

FIG. 1 is a side on perspective of a separating device/ according to the present invention, in situ;

FIG. 2 is an end-on elevation of the device depicted in FIG. 1; and

FIG. 3 is an enlarged partial section of the screen arrangement depicted in the previous figures.

In the drawings, a separator device manufactured from 0.6 mm zincalum 10 is shown fitted to the fascia 11 of a building (not illustrated) directly beneath a rainwater gutter 12. Fitting is achieved by means of a backing plate 13 which forms part of the rear wall of the separator and which extends between the fascia and the gutter. The backing plate can be screwed or otherwise secured in place.

The separator device comprises a square section compartment 14 having an inclined upwardly opening inlet covered by a main screen 15 and an inclined lower base wall 16 which opens into a discharge shute 17. The discharge shute in turn fits into the upper end of a downpipe 22.

The main screen 15 comprises a rectangular 5 mm stainless steel mesh 18 fitted to an L-section frame 19 (see FIG. 3) which fits over the compartment and is held in place by screws 20 which pass through opposite edges of the frame and the upper edge of the compartment. The main screen is supported at an angle of 30° with respect to the horizontal.

A secondary screen 23 (see FIG. 3) is located directly beneath the main screen at a spacing of about 5 mm therefrom. This screen is supported in a channel defined by a lip 24 on the upper end of the compartment and the interior of the L-section frame 19. The secondary screen is manufactured from 0.9 mm brass mesh and includes a rectangular support frame 25 to enable retention of shape and ease of placement. Placement is effected by means of a retaining screw 27 in the top of the main screen once the main screen has been removed from the compartment.

A tertiary screen 30 is located within the lower interior section of the compartment and overlies the discharge shute 17. The location of this screen is indicated by a dotted line in FIG. 2. The tertiary screen is fabricated from 0.9 mm bronze mesh and is rectangular in shape.

The separator device is complimented by a pop 31 which is riveted about an opening in the gutter. The opening is 75×200 mm so that large items of debris may pass through without difficulty. The pop has an inclined lower wall 32 which may match the inclination of the main screen 15.

In use, rainwater and debris washes by way of the opening in the gutter onto the main screen 15 where large items are withheld and washed out over the side of the compartment. Water and fine debris passes on through to the secondary screen 23 which removes the fines in suspension. The substantially cleansed water then passages downwardly through the compartment and tertiary screen 30, and enters the downpipe 17 for ultimate collection in a storage tank.

In this manner an efficient inexpensive arrangement for removing debris from rainwater is provided which needs little maintenance and meets the objective of the invention.

The claims defining the invention are as follows:

1. A device for separating debris and other such material from rainwater as it flows into a downpipe from a roof gutter and for simultaneously preventing the ingress of mosquitos into the downpipe, said device comprising a compartment adapted to be fitted to an upper end of the downpipe, which compartment includes an upwardly facing inlet having a main screen with a mesh size of between 5 mm×5 mm and 12.5 mm×12.5 mm arranged at an angle of between 20° and 45° with respect to an imaginary horizontal line so that debris washes over the main screen for discharge outside the device, the device further comprising a secondary screen located within the compartment of smaller mesh opening than the main screen, and being closely spaced from the main screen to act as a secondary filter below the main screen, through which rainwater passes, said device including a horizontally arranged tertiary screen having a mesh opening of approximately 0.9 mm×0.9 mm located below said secondary screen in such a manner that a head of water forms over said tertiary screen and which acts as a tertiary filter for excluding the ingress of mosquitos.

2. A device as claimed in claim 1 wherein the main screen is arranged at an angle of 30° with respect to the imaginary horizontal line.

3. A device as claimed in claim 1 wherein the secondary screen has a mesh size of approximately 0.9 mm×0.9 mm.

4. A device as claimed in claim 1 further comprising a pop for directing water and debris from the gutter onto the main screen of the separating device.

5. A device as claimed in claim 4, wherein the pop has an outlet inclined at a similar angle to the main screen in the separating device.

6. A device as claimed in claim 1 further comprising a backing panel to enable fixing to a fascia or wall.

* * * * *